US005094293A

United States Patent [19]

Shinmura

[11] Patent Number: 5,094,293

[45] Date of Patent: Mar. 10, 1992

[54] HEAT EXCHANGER

[75] Inventor: Toshiharu Shinmura, Takasaki, Japan

[73] Assignee: Sanden Corporation, Gunma, Japan

[21] Appl. No.: 658,313

[22] Filed: Feb. 20, 1991

[30] Foreign Application Priority Data

Feb. 22, 1990 [JP] Japan ..... 2-17170[U]

[51] Int. Cl.[5] ..... F28F 9/02

[52] U.S. Cl. ..... 165/178; 165/153; 165/173; 228/183

[58] Field of Search ..... 165/152, 153, 173, 178; 228/183

[56] References Cited

U.S. PATENT DOCUMENTS

| | | | |
|---|---|---|---|
| 2,506,051 | 5/1950 | Young | 165/178 X |
| 3,265,126 | 8/1966 | Donaldson | 165/153 X |
| 4,520,867 | 6/1985 | Sacca et al. | 165/144 |
| 4,620,590 | 11/1986 | Koisuka et al. | 165/150 |
| 5,022,464 | 6/1991 | Aoki et al. | 165/176 |

FOREIGN PATENT DOCUMENTS

| | | | |
|---|---|---|---|
| 2306999 | 8/1973 | Fed. Rep. of Germany | 165/153 |

*Primary Examiner*—Allen J. Flanigan

*Attorney, Agent, or Firm*—Banner, Birch, McKie & Beckett

[57] ABSTRACT

A heat exchanger is described which includes a plurality of flat tubes for conducting refrigerant and a plurality of corrugated fins fixedly sandwiched between the flat tubes. The flat tubes and the corrugated fins jointly form a heat exchange region. First and second header pipes are fixedly and hermetically connected to the flat tubes and communicate with the interior of the flat tubes. The header pipes are also provided with inlet and outlet pipes for connecting the heat exchanger to other external elements of an automotive air conditioning system. The inlet and outlet pipes protrude from opposite sides of the header pipes in the direction of thickness of the heat exchanger which is perpendicular to the longitudinal axes of the flat tubes. One end of each of the inlet and outlet pipes is shaped so as to prevent interference with the ends of the flat tubes that are inserted into the interior of the header pipes.

7 Claims, 5 Drawing Sheets

HEAT EXCHANGER

BACKGROUND OF THE INVENTION

1. Field of the Invention

The present invention relates to heat exchangers, and more particularly, to a heat exchanger for use in an automotive air conditioning system.

2. Description of the Prior Art

Japanese Utility Model Application Publication No. 63-142586 discloses a heat exchanger, such as a condenser for use in an automotive air conditioning system. The condenser includes a plurality of adjacent, essentially flat tubes having an oval cross-section and open ends which allow refrigerant fluid to flow therethrough. A plurality of corrugated fin units are disposed between the adjacent flat tubes. The flat tubes and fin units jointly form a heat exchange region.

A pair of cylindrical header pipes are disposed perpendicular to the flat tubes and may have, for example, a clad construction. The diameter and length of the header pipes are substantially equal to the thickness and height of the heat exchange region, respectively. Accordingly, the header pipes protrude only negligibly relative to the heat exchange region when the condenser is assembled.

An inlet pipe, which is provided with a union joint at one end, is fixedly and hermetically connected to an upper portion of one of the header pipes. An outlet pipe, which is provided with a union joint at its one end, is fixedly and hermetically connected to a lower portion of the other header pipe. The inlet and outlet pipes protrude from opposite sides of the header pipes parallel to the width of the condenser. In this construction, the direction along which the width of the condenser extends is perpendicular to the direction of air flow which passes through the heat exchange region of the condenser. When the condenser is mounted in the restricted space of an automobile engine compartment, a reduction of the width of the heat exchange region of the condenser is required. A width reduction is required because of the outwardly extending inlet and outlet pipes. The reduction of the width of the heat exchange region decreases the area of the heat exchange region, thereby decreasing the heat exchanging capability of the condenser.

A similar defect appears in the condenser that is disclosed in Japanese Patent Application Publication No. 63-161394. In this condenser, the inlet and outlet pipes protrude from the ends of the header pipes along the longitudinal axes of the header pipes. Therefore, because of the longitudinally extending inlet and outlet pipes, the height of the heat exchange region of the condenser must be reduced when the condenser is mounted in an automobile engine compartment. The reduction in height of the heat exchange region decreases the area of the heat exchange region, which also decreases the heat exchanging capability of the condenser.

In order to avoid the above-mentioned defects, i.e. a reduction in either the height and/or width of the heat exchange region of the heat exchanger, one technique has been proposed. Referring to FIGS. 1 and 2 of the drawings, a heat exchanger, such as a condenser C for use in an automotive air conditioning system is illustrated. Condenser C includes a plurality of adjacent, essentially flat tubes 10 having oval cross-sections and open ends which allow refrigerant fluid to flow therethrough. A plurality of corrugated fin units 11 are disposed between adjacent flat tubes 10. Each flat tube 10 includes a vertical partition wall 101 which is integrally formed on an inner surface of each flat tube 10 along the longitudinal axis so as to divide the inner chamber of each flat tube 10 into two identical chamber sections. The plurality of corrugated fin units 11 and flat tubes 10 jointly form heat exchange region 100.

Cylindrical header pipes 12 (only one of them being shown in FIGS. 1 and 2) having opposite open ends are disposed perpendicular to flat tubes 10 and may be of a clad construction. The opposite open ends of the header pipes are fixedly and hermetically plugged by caps 121 (only one of them being shown in FIG. 1).

In the assembly process, the opposite ends of each flat tube 10 penetrate the header pipes and terminate at the center of the inner periphery of each header pipe. Therefore, each of the header pipes and the opposite ends of flat tubes 10 are fully supported and fixedly attached when assembled. Effective brazing of the tubes and header pipes can thus be successfully accomplished after the assembly of condenser C.

The header pipe diameter and length are substantially equal to the heat exchange region thickness and height, respectively. Accordingly, the header pipes protrude only negligibly relative to heat exchange region 100 when condenser C is assembled.

A plate 102 having a generally U-shaped cross-section is fixedly disposed on an upper end of heat exchange region 100, and is fixedly connected to an outer peripheral surface or the uppermost end of the header pipes by, for example, brazing. Though not illustrated in FIGS. 1 and 2, another plate identical to plate 102 is fixedly disposed on a lower end of heat exchange region 100, and is fixedly connected to the outer peripheral surface on the lowermost end of the header pipes by, for example, brazing. The structural strength of the condenser is reinforced by the use of the pair of plates.

Circular opening 122 has a diameter which is slightly greater than the outer diameter H' of an inlet pipe 13 which is described in further detail below. Circular opening 122 is formed at an upper portion of header pipe 12 where an upper pair of adjacent flat tubes 10 penetrate cylindrical header pipe 12. Outer diameter H' of inlet pipe 13 is designed to be of a length greater than the length of interval L, which is the distance between a pair of adjacent flat tubes 10 located at the upper portion of heat exchange region 100.

One end of cylindrical inlet pipe 13 is inserted into opening 122 and is connected thereto by, for example, brazing. The other end or free end of inlet pipe 13 is provided with a union joint (not shown). Though not illustrated in FIGS. 1 and 2, a cylindrical outlet pipe is provided with a union joint at the free end thereof and is connected to a lower portion of the other head pipe in the same manner as described above. The inlet and outlet pipes protrude from the header pipes on opposite sides of condenser C parallel to the thickness or depth of the condenser. In this construction, the thickness or depth dimension of the condenser is parallel with the direction of air flow passing therethrough, as indicated by arrow A. Accordingly, a reduction in the width and/or height of heat exchange region 100, to fit within an engine compartment, is not required, because of the positions of the inlet and outlet pipes. Therefore, the heat exchanging capability of condenser C is maintained.

The manner of connecting the outlet pipe to the other header pipe is identical to the manner of connecting inlet pipe 13 to header pipe 12. Therefore, hereinafter, the manner described for connecting inlet pipe 13 to header pipe 12 will be representative only. Thus, those features described for inlet pipe 13 can readily be applied to the outlet pipe.

As illustrated in FIG. 1, outer diameter H' of inlet pipe 13 is designed to be of a length greater than the length of interval L. Therefore, the end of inlet pipe 13 cannot be sufficiently inserted into opening 122 because of interference between it and the ends of the adjacent flat tubes 10 located at the upper portion of heat exchange region 100. The brazing process is conducted after the assembly of the condenser. When the end of inlet pipe 13 is not fully supported in opening 122, the end of inlet pipe 13 is defectively brazed to an inner peripheral surface of opening 122. Therefore, leakage of the refrigerant fluid from an interior of header pipe 12 to the atmosphere can occur.

SUMMARY OF THE INVENTION

Accordingly, it is an object of the present invention to provide a heat exchanger which is designed to prevent a reduction of the width and/or height of a heat exchange region thereof while maintaining the structural integrity of the hermetic joints.

A heat exchanger in accordance with the present invention includes a plurality of tubes having opposite first and second open ends, and a plurality of fin units disposed between the tubes. The tubes and fin units jointly form a heat exchange region. First and second header pipes having opposite closed ends are fixedly and hermetically disposed at the opposite ends of each tube so the tubes fluidly communicate with the interior of the header pipes. A first fluid flows through the tubes. A second fluid, such as air, is caused to pass through the heat exchange region of the heat exchanger to effect a transfer of heat.

A pipe member links the heat exchanger to an external element of the refrigerant fluid circuit. The pipe member is fixedly and hermetically connected to the heat exchanger. One end of the pipe member penetrates through at least one of the header pipes and terminates within the interior of that header pipe. The pipe member extends in a direction parallel with the direction of flow of the second fluid which is parallel to the thickness dimension. The pipe member includes interference preventing means for preventing interference at one end thereof between the end of at least one of the tubes and the end of the pipe member.

DETAILED DESCRIPTION OF THE PREFERRED EMBODIMENTS

Figure 1:
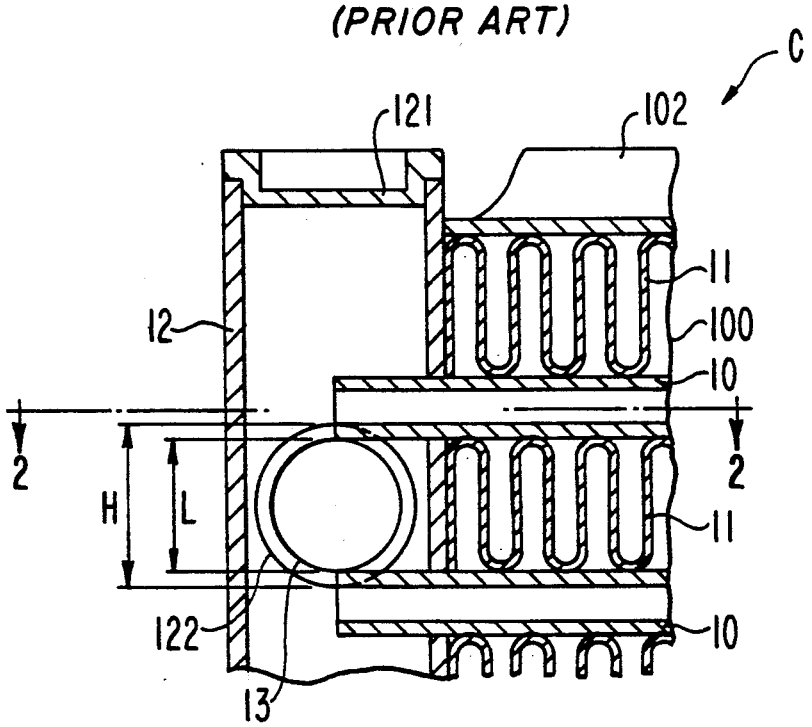
FIG. 1 (PRIOR ART)
FIG. 1 illustrates a partial vertical sectional view of a portion of a prior art condenser.
Figure 2:
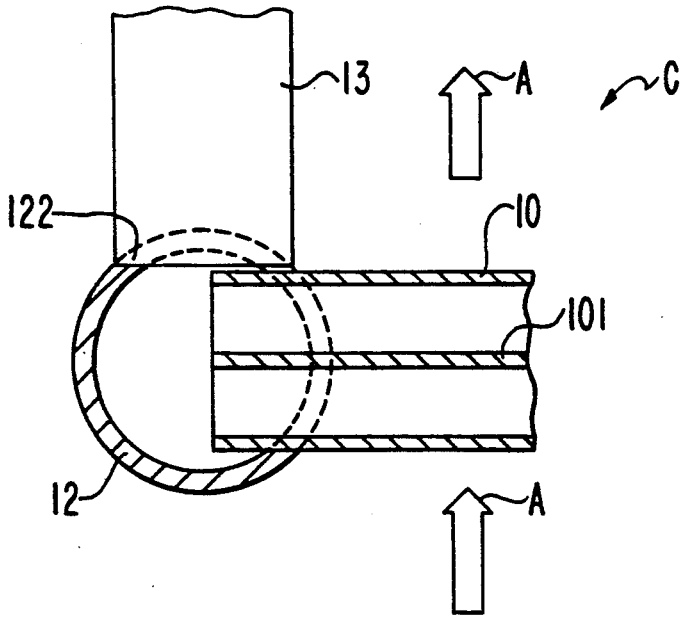
FIG. 2 (PRIOR ART)
FIG. 2 illustrates a cross-sectional view taken along line 2—2 of FIG. 1.
Figure 3:
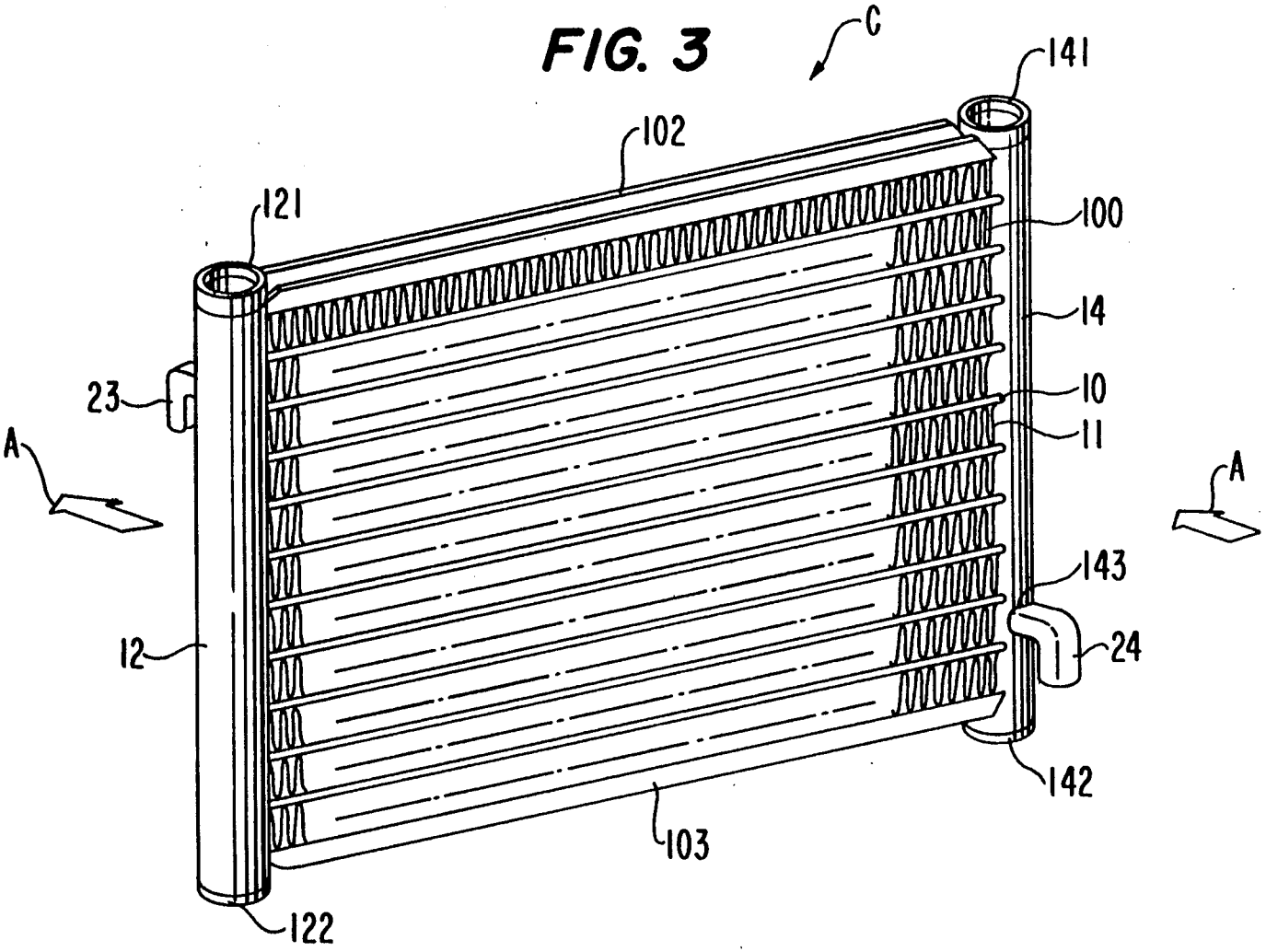
FIG. 3 illustrates a perspective view of a condenser made in accordance with a first embodiment of the present invention.
Figure 4:
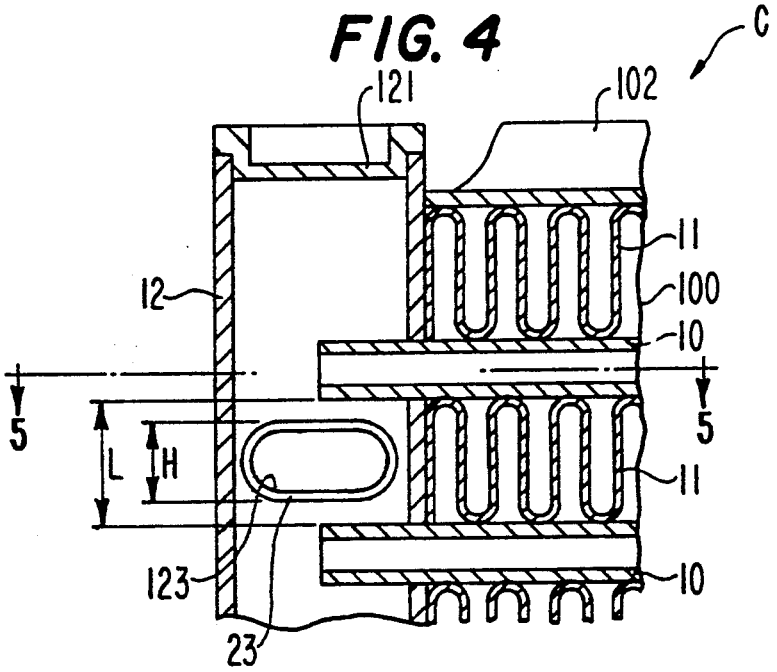
FIG. 4 illustrates a partial vertical sectional view of a portion of the condenser shown in FIG. 3.
Figure 5:
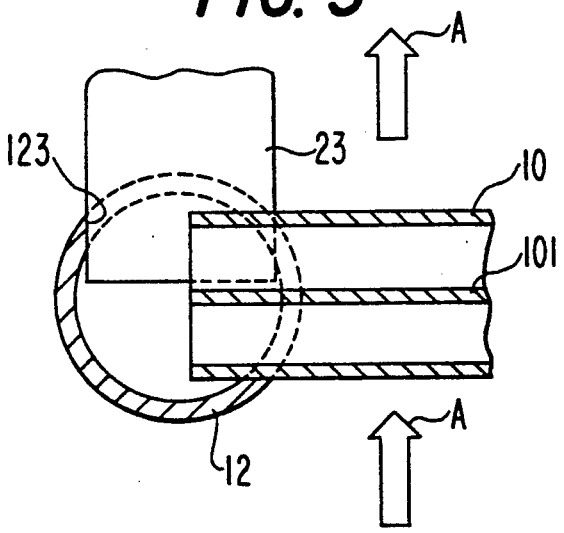
FIG. 5 illustrates a cross-sectional view taken along line 5—5 of FIG. 4.

FIGS. 3–5 illustrate a heat exchanger, such as a condenser, made in accordance with a first embodiment of the present invention for use in an automotive air conditioning system. Condenser C includes a plurality of adjacent, essentially flat tubes 10 having oval cross-sections and open ends which allow refrigerant fluid to flow therethrough. A plurality of corrugated fin units 11 are disposed between adjacent flat tubes 10. Each flat tube 10 includes a vertical partition wall 101 which is integrally formed on the inner surface of each flat tube along the tube longitudinal axis so as to divide the inner chamber into two identical chamber sections. A plurality of corrugated fin units 11 and flat tubes 10 jointly form heat exchange region 100.

A pair of cylindrical header pipes 12 and 14 having opposite open ends are disposed perpendicular to flat tubes 10 and may be of a clad construction. In assembling the condenser, the opposite ends of flat tubes 10 are inserted into header pipes 12, 14. The ends of flat tubes 10 terminate at the center of each respective header pipe. Therefore, when the header pipes and the opposite ends of each flat tube 10 are fixedly and hermetically assembled they are in fluid communication. Final assembly can be effectively achieved by a brazing process which is performed after all the parts of the condenser have been connected.

The opposite open ends of header pipes 12, 14 are fixedly and hermetically plugged by caps 121, 122, 141 and 142, respectively. The diameter and length of header pipes 12, 14 are substantially equal to the thickness and height of heat exchange region 100, respectively. Accordingly, header pipes 12, 14 protrude only negligibly relative to heat exchange region 100 when the condenser is assembled.

Plate 102 having a generally U-shaped cross-section is fixedly disposed on an upper end of heat exchange region 100, and is fixedly connected to an outer peripheral surface on the uppermost end of header pipes 12, 14 by, for example, brazing. Plate 103 also having a generally U-shaped cross-section is fixedly disposed on a lower end of heat exchange region 100, and is fixedly connected to an outer peripheral surface on the lowermost end of header pipes 12, 14 by, for example, brazing. The structural strength of condenser C is thus reinforced by the use of plates 102 and 103.

Oval opening 123, is of slightly greater dimensions than the outer dimensions of corresponding inlet pipe 23 which is described in greater detail below. Oval opening 123 is formed at an upper portion of header pipe 12 at a point where a pair of adjacent flat tubes 10 penetrate header pipe 12 at an upper portion of heat exchange region 100. The minor axis of oval opening 123 is perpendicular to the longitudinal axis of flat tubes 10. The length of the minor axis H of inlet pipe 23 is designed to be smaller than the length of interval L between adjacent flat tubes 10. The end of inlet pipe 23, which includes the oval cross-section, is inserted into opening 123 and is then fixedly and hermetically connected thereto by, for example, brazing. Inlet pipe 23 includes an elbow section with one leg being attached to header pipe 12 and the other leg being parallel to header pipe 12. Inlet pipe 23 can be provided with a union joint (not shown) which is attached to the leg which is parallel to header pipe 12.

Oval opening 143, similar to oval opening 123, is of slightly greater dimensions than the outer dimensions of corresponding outlet pipe 24. Oval opening 143 is formed at a lower portion of header pipe 14 at a point where a pair of adjacent flat tubes 10 penetrate header pipe 14. The minor axis of oval opening 143 is perpendicular to the longitudinal axis of flat tubes 10. The length of the minor axis of outlet pipe 24 is designed to be smaller than the interval L between adjacent flat tubes 10. One end of outlet pipe 24 is inserted into opening 143 and then is fixedly and hermetically connected thereto in the same manner as described above with regard to inlet pipe 123. Outlet pipe 24 is also formed as an elbow with one leg of the elbow being parallel with header pipe 14. Outlet pipe 24 can also be provided with a union joint (not shown) which is attached to the parallel leg. Inlet and outlet pipes 23 and 24 protrude from opposite sides of header pipes 12, 14 in a direction parallel to the thickness or depth dimension of the condenser. Accordingly, a reduction in the width and/or height of heat exchange region 100 of the condenser is not required when the condenser is mounted in the limited space of an automobile engine compartment because of the positions of inlet and outlet pipes 23, 24. Therefore, the heat exchanging capability of the condenser is maintained.

The manner of connecting the outlet pipe to a header pipe is identical to the manner of connecting the inlet pipe to a header pipe. Therefore, hereinafter, the manner of connecting the inlet pipes to the header pipes will be exemplary and the description of the connection of the outlet pipe will be omitted.

As illustrated in FIG. 4, the length of the minor axis H of inlet pipe 23 is designed to be smaller than the length of interval L between adjacent flat tubes 10. Therefore, one end of inlet pipe 23 can be sufficiently inserted into opening 123 without interference with the ends of a pair of adjacent flat tubes 10, when the condenser is assembled. Hence, one end of inlet pipe 23 is fully supported in opening 123. Thus, if the brazing process is conducted after the assembling of the parts of the condenser, the integrity of the hermetic connection between the inlet pipe and the header pipe is not adversely effected. Accordingly, the end of inlet pipe 23 is effectively brazed to the inner surface of opening 123. Therefore, leakage of the refrigerant fluid from the interior of header pipe 12 to the atmosphere can be prevented. Additionally, the condenser is designed to be used in an engine compartment without reducing the width and/or height of heat exchange region 100.

Figure 6:
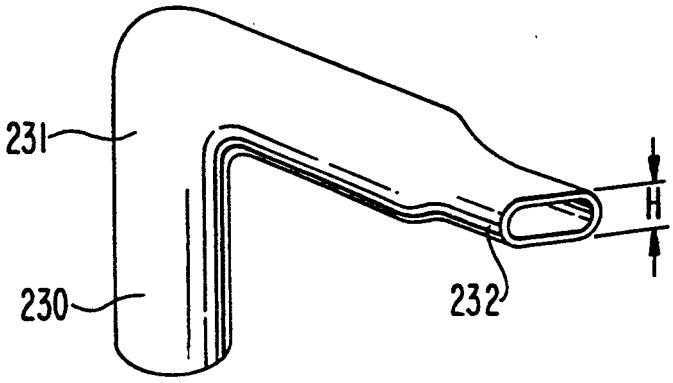
FIG. 6 illustrates a perspective of an inlet pipe of a condenser formed in accordance with a second embodiment of the present invention.

The inlet pipe disclosed in the first embodiment can be modified as illustrated in FIG. 6. Referring to FIG. 6, a second embodiment is disclosed. Inlet pipe 230 comprises a cylindrical elbow portion 231 with an elliptical cylinder portion 232, which has a cross-section similar to oval opening 123. The dimensions of the minor axis H of elliptical cylinder portion 232 is designed to be smaller than interval L. Therefore, elliptical cylinder portion 232 can be sufficiently inserted into opening 123 without interference with the ends of flat tubes 10. Thus, the size of the heat exchange region 100 is not required to be changed and the integrity of the connection of elliptical portion 232 to the header pipe is not adversely effected.

Figure 13:
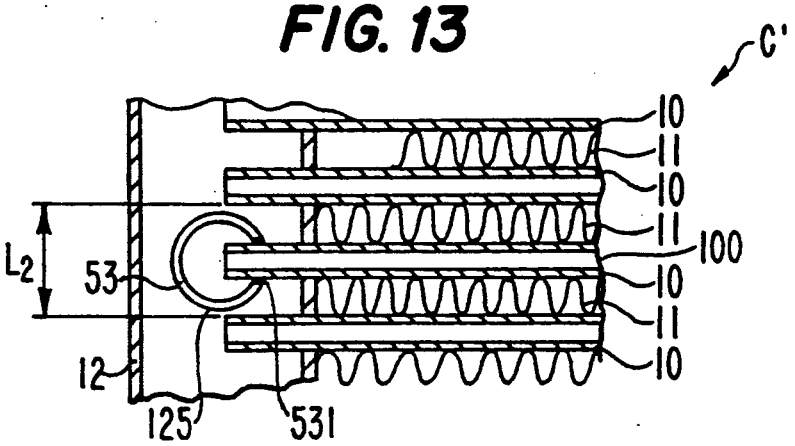
FIG. 13 illustrates a partial vertical sectional view of a portion of the condenser which includes the inlet pipe shown in FIG. 12.

Third, fourth and fifth embodiments of the present invention are described hereinafter and can also be used in situations where the heat exchanger is designed to include a greater number of tubes which reduces the interval between adjacent flat tubes 10. Thus, an increase in the number of flat tubes occurs without an increasing in the height of heat exchange region 100 as illustrated in FIGS. 8, 11, and 13.

Figure 7:
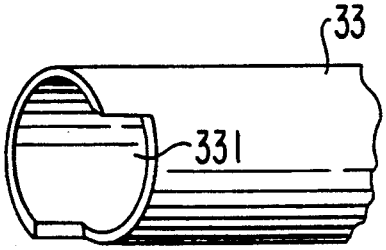
FIG. 7 illustrates an end portion of an inlet pipe of a condenser formed in accordance with a third embodiment of the present invention.
Figure 8:
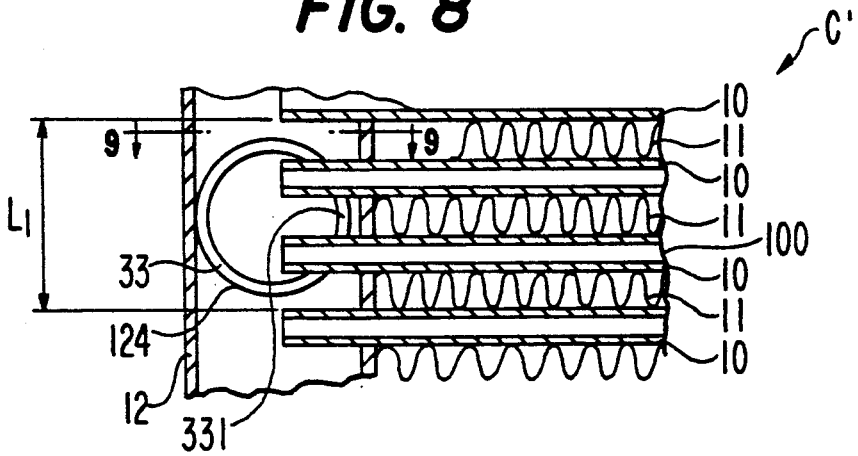
FIG. 8 illustrates a partial vertical sectional view of a portion of the condenser which includes the inlet pipe shown in FIG. 7.
Figure 9:
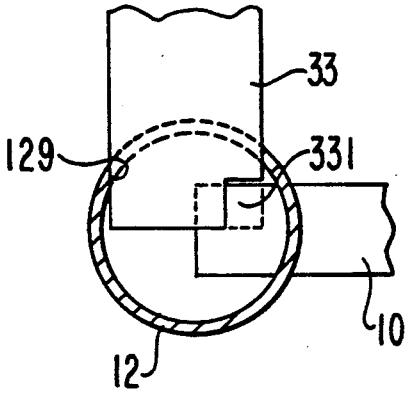
FIG. 9 illustrates a cross-sectional view taken along line 9—9 of FIG. 8.

FIGS. 7–9 illustrate a condenser C′ made in accordance with a third embodiment of the present invention. The condenser comprises cylindrical inlet pipe 33 having a cut-out portion 331 formed at one end thereof. Circular opening 124, is of a diameter that is slightly greater than the outer diameter of inlet pipe 33. Circular opening 124 is formed at an upper portion of header pipe 12 closely adjacent a point where at least one pair of adjacent flat tubes 10 penetrate the header pipe. The outer diameter of inlet pipe 33 is designed to be smaller than interval L1 which corresponds to a distance spanned by four consecutive flat tubes 10. Cut-out portion 331 is formed along a circular arc on one end of inlet pipe 33 to avoid interference with a pair of adjacent flat tubes 10 located at opening 124 and the end of inlet pipe 33. Therefore, the condenser can be assembled with one end of inlet pipe 33 sufficiently inserted into opening 124 without interference yet be fully supported within the opening. Therefore, the integrity of the connection between the inlet pipe and the header pipe is not compromised, while the height of the heat exchange area need not be changed.

Furthermore, in this embodiment, pressure reduction at inlet pipe 33 is negligible because inlet pipe 33 need not be narrowed. Thus, the flow of the first heat exchange fluid is not restricted.

Figure 10:
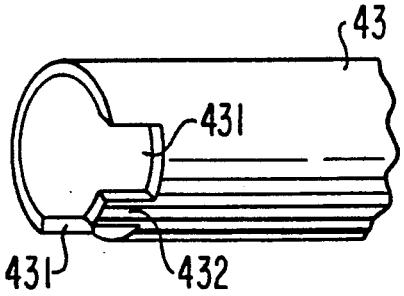
FIG. 10 illustrates an end portion of an inlet pipe of a condenser formed in accordance with a fourth embodiment of the present invention.
Figure 11:
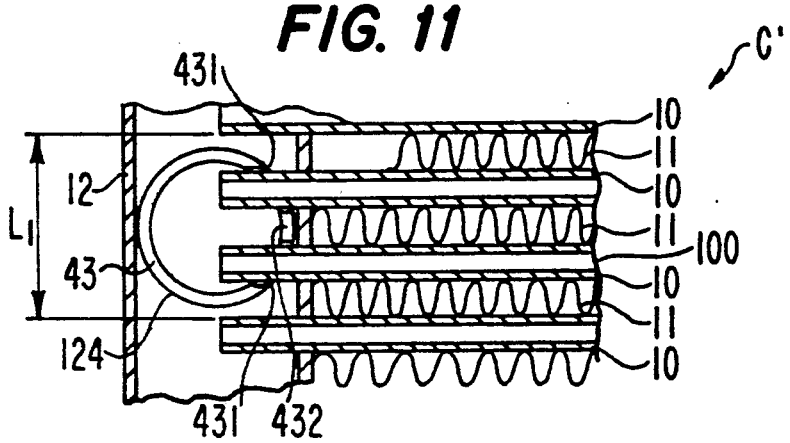
FIG. 11 illustrates a partial vertical sectional view of a portion of the condenser which includes the inlet pipe shown in FIG. 10.

FIGS. 10 and 11 illustrate a condenser similar to condenser C′, however this condenser includes an inlet pipe formed in accordance with a fourth embodiment of the present invention. The condenser includes cylindrical inlet pipe 43 having a pair of cut-out portions 431 formed at one end thereof. Circular opening 124 is of slightly greater diameter than the outer diameter of inlet pipe 43. The outer diameter of inlet pipe 43 is smaller than interval L1 which is described above. Cut-out portions 431 are formed along a circular arc at one end of inlet pipe 43 with a tab portion 432 remaining therebetween. Thus, cut-out portions 431 and tab portion 432 allow inlet pipe 43 to be connected to header pipe 12 without interference with flat tubes 10.

Figure 12:
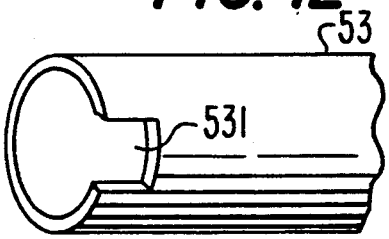
FIG. 12 illustrates an end portion of an inlet pipe of a condenser formed in accordance with a fifth embodiment of the present invention.

FIGS. 12 and 13 illustrate a condenser C′ which includes an inlet pipe made in accordance with a fifth embodiment of the present invention. The condenser comprises cylindrical inlet pipe 53 having cut-out portion 531 formed at one end thereof. Circular opening 125 has a diameter slightly greater than the outer diameter of inlet pipe 53. The outer diameter of inlet pipe 53 is designed to be smaller than interval L2. Cut-out portion 531 is formed along a circular arc on one end of inlet pipe 53 to avoid interference with an end of a flat tube 10 located at opening 125.

The advantages obtained from the fourth and fifth embodiments are similar to the advantages of the third embodiment. Thus, it is readily apparent that the heat exchange region need not be changed to accommodate the inlet pipes or to fit within an engine compartment.

This invention has been described in detail in connection with several preferred embodiments. The description herein above is for illustrative purpose only and the invention is not limited thereto. It will be easily understood by those skilled in the art that variations and modifications can be easily made within the scope of this invention as defined by the appended claims.

I claim:

1. In a heat exchanger for use in a refrigerant fluid circuit, said heat exchanger comprising first and second header pipes, each having two closed ends, a plurality of parallel tubes extending between said first and second header pipes at spaced intervals, each tube having first and second open ends extending into the interior of each respective header pipe and being fixedly and hermetically coupled thereto, said header pipes and said tubes being capable of receiving a first fluid, a plurality of fin units disposed between said tubes, said fin units being capable of receiving a second fluid, at least one pipe member linking said heat exchanger to an external element of said refrigerant fluid circuit, said at least one pipe member having one end penetrating and extending into the interior of at least one of said header pipes, said at least one pipe member extending parallel to the direction of flow of the second fluid, the improvement comprising:

said pipe member including interference preventing means at said one end thereof for preventing interference between said one end of said pipe member and the open end of at least one tube interior of said at least one header pipe, said pipe member being fixedly and hermetically connected to said at least one header pipe.

2. The heat exchanger of claim 1 wherein said interference preventing means includes a generally elliptical cylinder having a minor axis perpendicular to the longitudinal axes of said tubes, the minor axis being designed to be of a length shorter than the spaced interval between adjacent tubes.

3. The heat exchanger of claim 2 wherein said pipe member is a generally elliptical cylinder.

4. The heat exchanger of claim 1 wherein said interference preventing means includes a cut-out portion formed along a periphery at said one end of said pipe member so that at least one end of said tubes is received therein.

5. The heat exchanger of claim 4 wherein said pipe member is generally cylindrical.

6. The heat exchanger of claim 1 wherein said interference preventing means includes a first cut-out portion formed along a periphery at said one end of said pipe member and a second cut-out portion, spaced from said first cut-out portion, formed along the periphery at said one end so that each cut-out portion can loosely receive at least one tube end.

7. The heat exchanger of claim 6 wherein said tubes are generally flat.

* * * * *